US011608549B2

(12) United States Patent
Lee

(10) Patent No.: US 11,608,549 B2
(45) Date of Patent: Mar. 21, 2023

(54) CRYOGENIC STEEL PLATE AND METHOD FOR MANUFACTURING SAME

(71) Applicant: POSCO, Pohang-si (KR)

(72) Inventor: Hak-Cheol Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 54 days.

(21) Appl. No.: 16/763,061

(22) PCT Filed: Jun. 22, 2018

(86) PCT No.: PCT/KR2018/007090
§ 371 (c)(1),
(2) Date: May 11, 2020

(87) PCT Pub. No.: WO2019/098480
PCT Pub. Date: May 23, 2019

(65) Prior Publication Data

US 2020/0347487 A1 Nov. 5, 2020

(30) Foreign Application Priority Data

Nov. 17, 2017 (KR) ..... 10-2017-0154083

(51) Int. Cl.
*C22C 38/08* (2006.01)
*C21D 1/18* (2006.01)
(Continued)

(52) U.S. Cl.
CPC ..... *C22C 38/08* (2013.01); *C21D 1/18* (2013.01); *C21D 8/0205* (2013.01);
(Continued)

(58) Field of Classification Search
CPC ..... C21D 1/18; C21D 2211/002; C21D 2211/008; C21D 6/00; C21D 6/001;
(Continued)

(56) References Cited

U.S. PATENT DOCUMENTS 3,619,302 A * 11/1971 Aoki ..... C22C 38/08 148/621
4,776,900 A * 10/1988 Yano ..... C21D 8/005 148/336
(Continued)

FOREIGN PATENT DOCUMENTS

CN 1282381 A 1/2001
CN 103221562 A 7/2013
(Continued)

OTHER PUBLICATIONS

NPL: on-line English translation of JP 2011214100 A1, Oct. 2011 (Year: 2011).*
(Continued)

*Primary Examiner* — Jie Yang
(74) *Attorney, Agent, or Firm* — Morgan, Lewis & Bockius LLP

(57) ABSTRACT

Provided are a cryogenic steel plate and a method for manufacturing the same, the cryogenic steel plate comprising, in wt %, 0.04 to 0.08% carbon (C), 8.9 to 9.3% nickel (Ni), 0.6 to 0.7% manganese (Mn), and 0.2 to 0.3% silicon (Si), and 50 ppm or less of P, 10 ppm or less of S, and the remainder in iron (Fe) and various unavoidable impurities, and the microstructure at a ¼t location of the steel plate, where t is a thickness of the steel plate, comprising, in % surface area, 10% or more of tempered bainite, 10% or less of residual austenite, and the remainder of tempered martensite.

8 Claims, 1 Drawing Sheet

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/04*** | (2006.01) |

(52) U.S. Cl.
CPC ..... *C21D 8/0226* (2013.01); *C21D 9/46* (2013.01); *C22C 38/02* (2013.01); *C22C 38/04* (2013.01); *C21D 2211/001* (2013.01); *C21D 2211/002* (2013.01); *C21D 2211/008* (2013.01)

(58) Field of Classification Search
CPC ..... C21D 8/02; C21D 8/0205; C21D 8/0226; C21D 9/46; C22C 38/02; C22C 38/04; C22C 38/08
USPC ..... 420/119
See application file for complete search history.

(56) References Cited

U.S. PATENT DOCUMENTS

| | | | | |
|---|---|---|---|---|
| 5,454,883 | A | 10/1995 | Yoshie et al. | |
| 6,159,312 | A | 12/2000 | Koo et al. | |
| 2013/0292362 | A1* | 11/2013 | Fairchild ..... | B23K 35/3053 219/74 |
| 2015/0147222 | A1 | 5/2015 | Miura et al. | |

FOREIGN PATENT DOCUMENTS

| | | | | | |
|---|---|---|---|---|---|
| CN | 104487602 | A | | 4/2015 | |
| CN | 105349886 | A | | 2/2016 | |
| CN | 105683401 | A | | 6/2016 | |
| EP | 2641987 | A2 | | 9/2013 | |
| EP | 2871255 | A1 | | 5/2015 | |
| EP | 3098331 | A1 | * | 11/2016 | ..... C22C 38/48 |
| JP | S61-143516 | A | | 7/1986 | |
| JP | 06179909 | A | * | 6/1994 | |
| JP | H06-179909 | A | | 6/1994 | |
| JP | H06-240348 | A | | 8/1994 | |
| JP | H07-150239 | A | | 6/1995 | |
| JP | H07-173534 | A | | 7/1995 | |
| JP | H09-256039 | A | | 9/1997 | |
| JP | 2008-081776 | A | | 4/2008 | |
| JP | 2011-214098 | A | | 10/2011 | |
| JP | 2011-214100 | A | | 10/2011 | |
| JP | 2011-219848 | A | | 11/2011 | |
| JP | 2013-014811 | A | | 1/2013 | |
| JP | 2014-125678 | A | | 7/2014 | |
| KR | 10-2001-0062884 | A | | 7/2001 | |
| KR | 10-2004-0054198 | A | | 6/2004 | |
| WO | 99/32672 | A1 | | 7/1999 | |

OTHER PUBLICATIONS

NPL: on-line translation of Akiyama et al (JP-06179909 A) Jun. 1994 (Year: 1994).*

International Search Report dated Oct. 11, 2018 issued in International Patent Application No. PCT/KR2018/007090 (with English translation).

Extended European Search Report dated Aug. 5, 2020 issued in European Patent Application No. 18878035.7.

Japanese Office Action dated Jul. 13, 2021 issued in Japanese Patent Application No. 2020-526506.

Chinese Office Action dated Apr. 23, 2021 issued in Chinese Patent Application No. 201880073403.5 (with English translation).

Chinese Office Action dated Feb. 8, 2022 issued in Chinese Patent Application No. 201880073403.5 (with English translation).

* cited by examiner

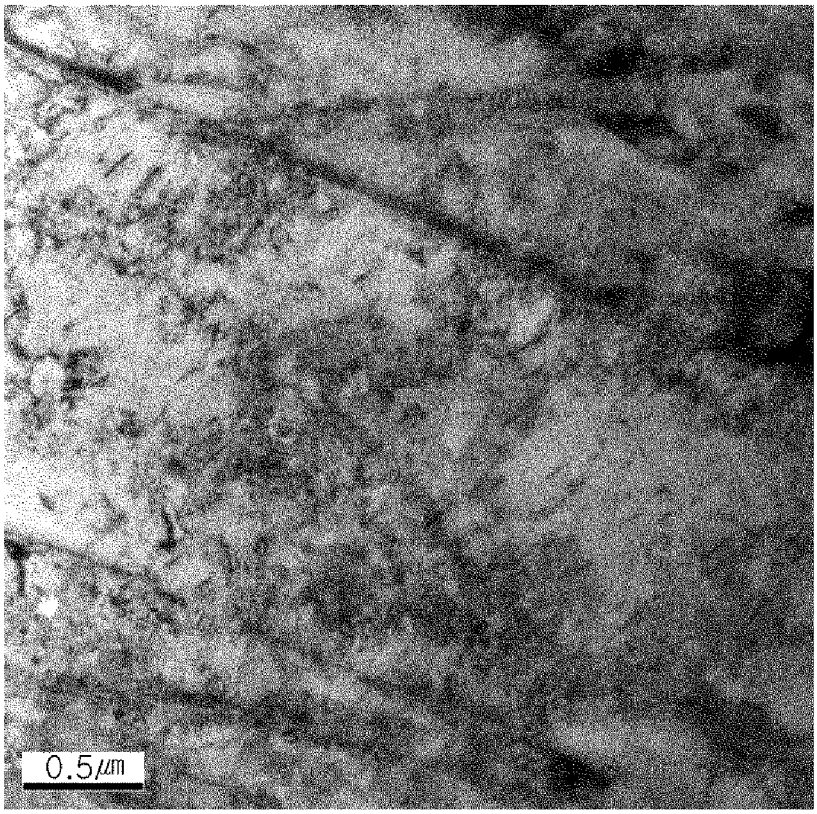
0.5μm

CRYOGENIC STEEL PLATE AND METHOD FOR MANUFACTURING SAME

CROSS-REFERENCE OF RELATED APPLICATIONS

This application is the U.S. National Phase under 35 U.S.C. § 371 of International Patent Application No. PCT/KR2018/007090, filed on Jun. 22, 2018, which in turn claims the benefit of Korean Application No. 10-2017-0154083, filed on Nov. 17, 2017, the entire disclosures of which applications are incorporated by reference herein.

TECHNICAL FIELD

The present disclosure relates to a cryogenic steel plate used in a structural material such as a cryogenic storage container, for liquefied natural gas (LNG), or the like, and a method for manufacturing the same, and more particularly to a cryogenic steel plate direct quenched containing nickel (Ni) using bainite and a method for manufacturing the same.

BACKGROUND

As the world's LNG consumption has steadily increased due to the reduction of costs and an increase in efficiency through LNG's eco-friendliness and technological advances, LNG consumption, which was only 23 million tons in six countries in 1980, has doubled in size approximately every 10 years. As the LNG market expands and grows, existing facilities are being remodeled or expanded between LNG producing countries, and countries that are producing natural gas are also trying to construct production facilities to enter the LNG market.

LNG storage containers are classified according to various criteria such as purpose of equipment (storage tanks, transport tanks), installation location, and internal and external tank types.

Thereamong, the type of internal tank is divided into 9% Ni steel plate internal tanks, membrane internal tanks, and concrete internal tanks according to the material and shape. Recently, as a use of the LNG storage containers in a form of a 9% Ni steel plate to increase stability of LNG carriers has expanded from a storage tank to a transportation tank field, a global demand for the 9% Ni steel plate is increasing.

In general, in order to be used as a material for an LNG storage container, it must have excellent impact toughness at cryogenic temperatures, and a high strength level and ductility are required for stability of the structure.

A 9% Ni steel plate is generally produced through a process of quenching-tempering (QT) or quenching-lamellarizing-tempering (QLT) after rolling, and it has soft phase, austenite as a secondary phase in a martensitic matrix having fine crystal grains, and thus shows good impact toughness at cryogenic temperatures. However, in the case of the 9% Ni steel plate, it has a disadvantage of increasing production costs and overloading of a heat treatment facility compared to a general heat treatment material through several heat treatment processes.

In order to solve these shortcomings, technologies of direct quenching in which a quenching process is omitted in a manufacturing process of the existing 9% Ni steel plate and direct quenching-tempering (DQT) was developed, and it was possible to reduce manufacturing costs and reduce heat treatment load by omitting the reheating and quenching process in the existing process.

However, compared to the general quenching process, due to a rapid cooling rate of the direct quenching (DQ) process, there is a problem that the heat treatment time must be increased during the tempering process by increasing quenching properties, and there is also a problem that it is difficult to control the shape of the product due to an increase in residual stresses inside a microstructure.

DISCLOSURE

Technical Problem

A preferred aspect of the present disclosure is to provide a cryogenic steel plate having high strength and excellent ductility as well as impact toughness and flatness at a cryogenic temperature.

Another preferred aspect of the present disclosure is to provide a method of manufacturing a cryogenic steel plate having high strength and excellent ductility as well as impact toughness and flatness at a cryogenic temperature by a direct quenching and tempering method.

Technical Solution

According to a preferred aspect of the present disclosure, a cryogenic steel plate includes, in wt %, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and a microstructure at a ¼t location of the steel plate, where t is a thickness of the steel plate, includes, in % surface area, 10% or more of tempered bainite, 10% or less of residual austenite, and a remainder of tempered martensite.

The thickness of the steel plate may be 10 to 45 mm.

According to another preferred aspect of the present disclosure, a cryogenic steel plate manufactured by tempering after direct quenching a steel plate is provided. The cryogenic steel plate includes, in wt %, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and a microstructure of the steel plate prior to tempering, after direct quenching, includes, in % surface area, 10% or more bainite in a martensite base, and a microstructure of the steel plate after tempering includes, in % surface area, at a ¼t location of the steel plate, where t is a thickness of the steel plate, includes, in % surface area, 10% or more of tempered bainite, 10% or less of residual austenite, and a remainder of tempered martensite.

After the direct quenching, an average prior austenite grain size of the microstructure of the steel plate may be 30 μm or less.

According to another preferred aspect of the present disclosure, a method for manufacturing a cryogenic steel plate including operations of: heating a steel slab including, in wt %, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and then finish hot rolling at a temperature of 900° C. or less to obtain a steel plate; direct quenching of cooling the steel plate at a cooling rate of 10 to 40° C./sec; and tempering the steel plate, directly quenched as described above, at a temperature of 580 to 600° C., wherein a microstructure of the steel plate prior to the tempering operation after the direct quenching operation includes, in % surface area, 10% or more of bainite in a martensitic matrix.

The thickness of the steel plate may be 10 to 45 mm.

Advantageous Effects

According to a preferred aspect of the present disclosure, a cryogenic steel plate having excellent strength and excellent ductility as well as having excellent impact toughness and flatness at cryogenic temperatures can be manufactured by a direct quenching and tempering method.

Various and beneficial advantages and effects of the present disclosure are not limited to the above, and will be more readily understood in the course of describing the specific embodiments of the present disclosure.

DESCRIPTION OF DRAWINGS

FIG. 1 is a microstructure photograph of a steel plate including bainite after direct quenching of Inventive steel 1.

BEST MODE FOR INVENTION

A 9% Ni steel plate has provisions of ingredients such as type 510 in accordance with ASTM A553 type-1, JIS SL9N590, and BS 1501-2 depending countries. In addition to 9% of Ni, by weight, C, Mn, Si, etc. are included, and an amount of P and S is regulated to control problems such as impact toughness deterioration. The present disclosure relates to a cryogenic steel plate based on a component system (% by weight) satisfying the above-mentioned ASTM and component regulations of 9% of Ni steel in each country.

The present inventors have conducted research and experiments to solve the problems of the method for manufacturing a cryogenic steel plate containing nickel (Ni) using direct quenching and tempering, and have completed the present invention based on the results thereof.

In the present disclosure, by controlling a steel composition, manufacturing conditions, in particular, controlling a cooling rate during direct quenching, a microstructure after direct quenching may be controlled to a two-phase structure of martensite and bainite, rather than a martensitic single-phase structure, and in a subsequent tempering process, austenite may be easily nucleated through the bainite structure, thereby a tempering time and improving impact toughness.

In the present invention, the shape of the steel plate, in particular, the flatness of the steel plate, could also be improved by reducing residual stress inside the microstructure through control cooling. The shape of the steel plate, in particular, flatness of the steel plate is deteriorated, which occurs due to the occurrence of local residual stresses as a transformation time varies depending on the cooling rate variation of each part during cooling. If the cooling rate is controlled, that is, if the cooling rate is reduced, deviation in the cooling rate for each part decreases, and thus a difference in a martensite transformation time decreases, so that the occurrence of the local residual stress due to phase transformation decreases, and the shape of the steel plate, in particular, the flatness of the steel plate is also improved.

Hereinafter, a cryogenic steel plate according to a preferred aspect of the present disclosure will be described.

According to a preferred aspect of the present disclosure, a cryogenic steel plate includes, in wt %, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and a microstructure at a ¼t location of the steel plate, where t is a thickness of the steel plate, includes, in % surface area, 10% or more of tempered bainite, 10% or less of residual austenite, and a remainder of tempered martensite.

Carbon (C): 0.04 to 0.08 by weight % (hereinafter, referred to as "%")

Carbon is an important element in reducing a martensite transformation temperature and stabilizing austenite. However, as a content of carbon increases, strength increases, but toughness decreases. The content of carbon is preferably included in 0.04% or more in order to secure physical properties required by the present disclosure within a following Ni composition range, and it is preferable to limit an upper limit thereof to 0.08% in order to secure ductility.

Nickel (Ni): 8.9 to 9.3%

Nickel is the most important element in improving strength of steel and stabilizing austenite. As a content of nickel increases, martensite and bainite structures can be formed as a main structure. However, if the content of nickel in the carbon range is less than 8.9%, mechanical properties may be deteriorated due to formation of microstructures such as upper bainite, or the like, and when it exceeds 9.3%, toughness may be deteriorated due to high strength. Therefore, the content of nickel is preferably limited to 8.9 to 9.3%.

Manganese (Mn): 0.6 to 0.7%

Manganese is an element that stabilizes the martensite structure by lowering the martensitic transformation temperature, and improves the stability of austenite. However, as a content of manganese increases, strength of a matrix may increase and the toughness may decrease, so it is preferable to limit the content of manganese to 0.6 to 0.7%.

Silicon (Si): 0.2 to 0.3%

Silicon acts as a deoxidizer and improves strength with solid solution strengthening. It also suppresses generation of carbides during tempering, thereby improving the stability of austenite. However, the higher the content of silicon, the lower the toughness, so the content of the silicon is preferably limited to 0.2 to 0.3%.

P: 50 ppm or less, S: 10 ppm or less

P, S is an element that causes brittleness at a grain boundary or forms a coarse inclusion, which can cause a problem of deteriorating impact toughness when being tempered. Thus, in the present disclosure, it is preferable to limit to P: 50 ppm or less and S: 10 ppm or less.

The remaining component of the present disclosure is iron (Fe). However, in an ordinary steel manufacturing process, unintended impurities from raw materials or the surrounding environment may inevitably be mixed, and therefore cannot be excluded. Since these impurities are known to any one skilled in the ordinary steel manufacturing process, they are not specifically mentioned in the present specification.

According to a preferred aspect of the present disclosure, in a cryogenic steel plate, and a microstructure at a ¼t location of the steel plate, where t is a thickness of the steel plate, includes, in % surface area, 10% or more of tempered bainite, 10% or less of residual austenite, and a remainder of tempered martensite.

When the microstructure of the steel plate contains more than 10% of residual austenite, there is a concern that impact toughness decreases due to a decrease in stability of the residual austenite, so it is preferable to include 10% or less of residual austenite. The residual austenite fraction may be 3 to 10%.

The tempered bainite fraction may be 10 to 30%. The steel plate is a cryogenic steel plate prepared by tempering after direct quenching, and a microstructure of the steel plate prior to quenching after direct quenching may include, in % surface area, 10% or more of bainite in a martensitic matrix.

When the microstructure of the steel plate prior to tempering after direct quenching includes less than 10% of bainite in the martensitic matrix, there is a concern that impact toughness may be deteriorated because 3% or more retained austenite may not be obtained, so it is preferable to include 10% or more of bainite in the martensitic base. The bainite fraction may be 10 to 30%.

After the direct quenching, an average prior austenite grain size of the microstructure of the steel plate may be 30 μm or less.

The steel plate may have a yield strength of 490 Mpa or more, a tensile strength of 640 Mpa or more, an elongation of 18% or more, and an impact toughness (impact energy) of 41 J or more at −196° C.

The thickness of the steel plate may be 10 to 45 mm.

Hereinafter, a method for manufacturing a cryogenic steel plate according to another preferred aspect of the present disclosure will be described.

According to another preferred aspect of the present disclosure, a method for manufacturing a cryogenic steel plate comprising operations of:

heating a steel slab including, in wt o, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and then finish hot rolling at a temperature of 900° C. or less to obtain a steel plate;

direct quenching of cooling the steel plate at a cooling rate of 10 to 40° C./sec; and tempering the steel plate directly quenched as described above at a temperature of 580 to 600° C., wherein a microstructure of the steel plate prior to the tempering operation after the direct quenching operation comprises, in % surface area, 10% or more of bainite in a martensitic matrix.

Operation of Obtaining Steel Plate

After heating a steel slab having the above-described composition, finish hot rolling the steel slab at a temperature of 900° C. or lower to obtain a steel plate.

When heating the steel slab, a heating temperature is not particularly limited, and may be, for example, 1100 to 1200° C.

When the finish hot rolling temperature is higher than 900° C., crystal grains of austenite may become coarse, and toughness may deteriorate. Therefore, it is preferable to limit the finish hot rolling temperature to 900° C. or less. In consideration of manufacturing environments, or the like, the finish hot rolling temperature may be limited to 700 to 900° C.

The thickness of the steel plate may be 10 to 45 mm.

Direct Quenching Operation

Direct quenching is performed to cool the steel plate obtained as described above at a cooling rate of 10 to 40° C./sec.

In the component range of the cryogenic steel described above, since a bainite or ferrite generation curve moves rapidly backward on a continuous cooling transformation diagram, bainite and martensite may be stably obtained even at a cooling rate, lower than carbon steel during direct quenching after hot rolling or solution treatment, and it is possible to control a phase fraction inside the microstructure through controlling the cooling rate.

Bainite produced during direct quenching includes a carbide included inside the structure, and austenite is easily nucleated in the carbide during tempering, thereby reducing a tempering time and improving impact toughness.

During direct quenching of hot-rolled steel plate, the cooling rate exceeds 40° C./sec, a bainite fraction in the microstructure falls below 10%, so it is not expected to improve impact toughness using bainite and it becomes difficult to control the shape of the product.

When the cooling rate is less than 10° C./sec, coarse upper bainite may be generated and toughness may decrease. Therefore, it is preferable to control the cooling rate at 10 to 40° C./sec during direct quenching.

A microstructure of the steel plate after the direct quenching includes, in % surface area, 10% or more of bainite in a martensitic matrix.

When the microstructure after direct quenching contains less than 10% of bainite in the martensitic matrix, there is a concern that the residual austenite of 3% or more cannot be secured, and impact toughness may be deteriorated, so it is preferable to include 10% or more of bainite in the martensitic matrix. The bainite fraction may be 10 to 30%.

An average prior austenite grain size of the microstructure after direct quenching may be 30 μm or less.

Impact toughness at low temperatures increases as an effective grain size of the microstructure decreases. The cryogenic steel of the present disclosure has bainite and martensite as a microstructure, and since in both structures, an effective grain size is determined as an average prior austenite grain size of the microstructure, and thus, when the average prior austenite grain size of the microstructure is 30 μm or less, impact toughness may be improved due to microstructure refinement.

Tempering Operation

The steel plate, directly quenched as described above, is treated at a temperature of 580 to 600° C.

The cryogenic steel plate of the present disclosure improves impact toughness by generating around 10% of austenite in addition to improving impact toughness through softening of the matrix during tempering to improve impact toughness.

Unlike a general quenching method, since a residual stress due to the rapid cooling rate during direct quenching remains inside the structure, a tempering temperature of 580° C. or higher is preferable to remove it and soften the matrix.

Meanwhile, when the tempering temperature exceeds 600° C., the stability of austenite generated in the microstructure decreases, and as a result, the austenite can easily transform into martensite at a cryogenic temperature, thereby lowering the impact toughness, so the tempering temperature is preferably in a range of 580 to 600° C.

The tempering may be performed for a time of 1.9t (t is steel thickness, mm)+40 to 80 minutes.

A microstructure of the hot-rolled steel plate after the tempering treatment includes 10% or more of bainite, 10% or less of residual austenite, and remaining tempered martensite.

When the microstructure of the steel plate after the tempering treatment includes more than 10% of residual austenite, there is a concern that the impact toughness decreases due to a decrease in the stability of the residual austenite, so it is preferable to include 10% or less of residual austenite. The residual austenite fraction may be 3 to 10%.

MODE FOR INVENTION

Hereinafter, the present disclosure will be described in more detail through embodiments. The present disclosure is not limited to the following embodiments. This is because the scope of the present disclosure is determined by the items described in the claims and the items reasonably inferred therefrom.

After a slab satisfying the component system shown in Table 1 is produced by steelmaking and casting for 2 times, and then hot rolled under conditions of hot finish rolling temperature on Table 2 below (final thickness of 10 to 45 mm), and a direct quenching and a tempering process was performed under the conditions of cooling rate and the tempering temperature in Table 2 below to prepare steel plates (Inventive steels 1 to 6 and Comparative steels 1 to 4).

Both Inventive steels and Comparative steels satisfy the component ranges consistent with the present disclosure.

All steel plates were treated with a tempering time of [1.9 t (t: steel thickness (mm))+40 minutes].

For the steel plate produced as above, a yield strength, a tensile strength, an elongation, and impact toughness, a microstructure of the steel plate after direct quenching (prior to tempering), a microstructure of the steel plate after tempering, and an prior austenite grain size were observed, and the results thereof were shown in Table 3 below. After direct quenching (prior to tempering), the structure other than bainite among microstructure of steel plates is martensite. Among the microstructures of the steel plates after tempering, a structure other than the tempered bainite and residual austenite is tempered martensite, and a tempered bainite fraction is the same as a fraction of bainite of the steel plate after direct quenching (prior to tempering).

Meanwhile, for Inventive steel 1, the microstructure of the steel plate after direct quenching was observed, and the results thereof were shown in FIG. 1.

FIG. 1 is a TEM photograph of an enlarged portion of bainite as a whole, and shows lower bainite.

TABLE 1

| Steel type | Chemical composition (by weight %) | | | | | |
|---|---|---|---|---|---|---|
| | C | Ni | Mn | Si | P | S |
| Inventive steel 1 | 0.066 | 9.1 | 0.65 | 0.24 | 0.0024 | 0.001 |
| Inventive steel 2 | | | | | | |
| Inventive steel 3 | | | | | | |
| Inventive steel 4 | 0.062 | 8.93 | 0.64 | 0.23 | 0.0037 | 0.001 |
| Inventive steel 5 | | | | | | |
| Inventive steel 6 | | | | | | |
| Comparative steel 1 | 0.066 | 9.1 | 0.65 | 0.24 | 0.0024 | 0.001 |
| Comparative steel 2 | | | | | | |
| Comparative steel 3 | 0.062 | 8.93 | 0.64 | 0.23 | 0.0037 | 0.001 |
| Comparative steel 4 | | | | | | |

TABLE 2

| Steel type | Finish rolling temperature (° C.) | Thickness of steel plate (mm) | Direct quenching cooling rate (° C./sec) | Tempering temperature (° C.) |
|---|---|---|---|---|
| Inventive steel 1 | 758 | 15 | 38.1 | 590 |
| Inventive steel 2 | 801 | 13 | 39.3 | 590 |
| Inventive steel 3 | 771 | 17 | 36.5 | 590 |
| Inventive steel 4 | 760 | 35 | 11.5 | 590 |
| Inventive steel 5 | 791 | 40 | 12.9 | 590 |
| Inventive steel 6 | 831 | 35 | 15.4 | 590 |
| Comparative steel 1 | 802 | 10 | 75.5 | 590 |
| Comparative steel 2 | 816 | 20 | 35.6 | 610 |
| Comparative steel 3 | 807 | 45 | 4.5 | 590 |
| Comparative steel 4 | 957 | 18 | 39.5 | 590 |

TABLE 3

| Steel type | Yield strength (Mpa) | Tensile strength (Mpa) | Elongation (%) | Impact toughness (−196° C.) (J) | Bainite fraction prior to tempering (in % surface area) | Residual austenite fraction after tempering (in % surface area) | Grain size prior austenite (μm) |
|---|---|---|---|---|---|---|---|
| Inventive steel 1 | 715 | 778 | 28.3 | 151 | 14.5 | 7.2 | 24.3 |
| Inventive steel 2 | 723 | 790 | 27.9 | 145 | 16.3 | 6.5 | 26.7 |
| Inventive steel 3 | 703 | 775 | 28.2 | 160 | 17.2 | 5.8 | 23.2 |
| Inventive steel 4 | 680 | 736 | 28.6 | 151 | 26.1 | 9.3 | 28.6 |
| Inventive steel 5 | 685 | 755 | 29.3 | 160 | 23.7 | 8.7 | 20.5 |
| Inventive steel 6 | 720 | 761 | 28.1 | 134 | 23.6 | 6.9 | 29.7 |
| Comparative steel 1 | 760 | 805 | 24.3 | 103 | 0 | 2.1 | 26.2 |

TABLE 3-continued

| Steel type | Yield strength (Mpa) | Tensile strength (Mpa) | Elongation (%) | Impact toughness (−196° C.) (J) | Bainite fraction prior to tempering (in % surface area) | Residual austenite fraction after tempering (in % surface area) | Grain size prior austenite (μm) |
|---|---|---|---|---|---|---|---|
| Comparative steel 2 | 630 | 742 | 29.3 | 75 | 16.3 | 13.8 | 27.3 |
| Comparative steel 3 | 687 | 760 | 28.3 | 43 | 39.5 | 8.9 | 39.3 |
| Comparative steel 4 | 755 | 790 | 26.1 | 105 | 13.2 | 4.5 | 37.5 |

As shown in Tables 1 to 3, it can be seen that in Comparative steel 1, although an prior austenite grain size required by the present invention is satisfied, a martensite single-phase structure was formed due to a rapid cooling rate outside of required cooling conditions of the present disclosure, and thus, it had a high strength level after tempering compared to Inventive steel and impact toughness was also reduced.

In addition, in the case of Comparative Steel 1, due to the rapid cooling rate, side waves and edge waves were generated after cooling in some plates, and thus a difficulty in securing the plate shape was shown.

In Comparative steel 2, both cooling conditions and the prior austenite grain size during direct quenching satisfy the scope of the present disclosure.

However, because it is tempered at a high temperature (610° C.) outside of the scope of the present disclosure, a lot of softening occurred in the matrix compared to other steel materials, and the strength is low, and at a temperature of 590° C., a lot of austenite, having low stability compared to tempering, is produced and transforms into martensite at a low temperature, and thus the lowest impact toughness exhibited compared to other steel types.

Comparative steel 3 is cooled at a rate, slower than the lower limit of the cooling rate suggested by the present disclosure during direct quenching, so that a large amount of upper bainite was generated and had coarse prior austenite grains, thereby exhibiting low impact toughness of 100 J or less.

Comparative steel 4 was manufactured under the same direct quenching cooling conditions as Inventive steels 1 and 2, but had a coarse prior austenite grain size as rolling was terminated at a high temperature, thereby reducing impact toughness Meanwhile, it can be seen that in Inventive steels 1 to 6, 10% or more of bainite was included in the microstructure and an average prior austenite grain size was 30 μm or less. For this reason, it was possible to secure excellent impact toughness while satisfying basic properties such as yield strength, tensile strength, and elongation after tempering. Meanwhile, it can be seen that Inventive steel 1 includes bainite as can be seen in FIG. 1 showing the microstructure of Invention steel 1 after direct quenching.

While example embodiments have been shown and described above, it will be apparent to those skilled in the art that modifications and variations could be made without departing from the scope of the present inventive concept as defined by the appended claims.

The invention claimed is:

1. A cryogenic steel plate comprising, in wt %: 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, wherein a thickness, t, of the steel plate is 10 to 20 mm, and wherein a microstructure at a ¼t location of the steel plate includes, in % surface area, 10% to 30% of tempered bainite, 3 to 10% of residual austenite, and a remainder of tempered martensite.

2. The cryogenic steel plate of claim 1, wherein the steel plate is a cryogenic steel plate manufactured by tempering after direct quenching a steel plate, and a microstructure of the steel plate prior to tempering after direct quenching comprises, in % surface area, 10% or more of bainite, in a martensitic matrix, and an average prior austenite grain size of the microstructure of the steel plate after the direct quenching is 30 μm or less.

3. The cryogenic steel plate of claim 2, wherein the bainite fraction is 10 to 30%.

4. The cryogenic steel plate of claim 1, consisting of, in wt %: 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities.

5. A method for manufacturing a cryogenic steel plate comprising operations of:

heating a steel slab including, in wt %, 0.04 to 0.08% of carbon (C), 8.9 to 9.3% of nickel (Ni), 0.6 to 0.7% of manganese (Mn), 0.2 to 0.3% of silicon (Si), 50 ppm or less of P, 10 ppm or less of S, and a remainder in iron (Fe) and various unavoidable impurities, and then finish hot rolling at a temperature of 900° C. or less to obtain a steel plate having a thickness of 10 to 20 mm;

direct quenching of cooling the steel plate at a cooling rate of 35.6 to 40° C./ sec; and tempering the steel plate directly quenched as described above at a temperature of 580 to 600° C. for a time of 1.9 t, where t is a steel thickness in mm, +40 to 80 minutes, wherein a microstructure of the steel plate prior to the tempering operation after the direct quenching operation comprises, in surface area %, 10% to 30% of bainite in a martensite matrix, wherein after the tempering operation, a microstructure at a ¼t location of the steel plate includes, in % surface area, 10% to 30% of tempered bainite, 3 to 10% of residual austenite, and a remainder of tempered martensite.

6. The method for manufacturing the cryogenic steel plate of claim 5, wherein the steel slab has a heating temperature of 1100 to 1200° C.

7. The method for manufacturing the cryogenic steel plate of claim 5, wherein the finish hot rolling temperature is 700 to 900° C.

8. The method for manufacturing the cryogenic steel plate of claim 5, wherein an average prior austenite grain size of the microstructure is 30 μm or less.

* * * * *